US008430695B2

(12) United States Patent
Ting et al.

(10) Patent No.: US 8,430,695 B2
(45) Date of Patent: Apr. 30, 2013

(54) ELECTRICAL CONNECTOR WITH WATERPROOF FUNCTION

(75) Inventors: Chien-Jen Ting, New Taipei (TW); Bin Xie, Kunshan (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/108,012

(22) Filed: May 16, 2011

(65) Prior Publication Data

US 2011/0287668 A1 Nov. 24, 2011

(30) Foreign Application Priority Data

May 18, 2010 (CN) ..... 2010 2 0192775

(51) Int. Cl.
*H01R 24/00* (2011.01)

(52) U.S. Cl.
USPC ..... 439/660

(58) Field of Classification Search ..... 439/660, 439/752, 83, 587–589, 274–275, 607.01, 439/607.04, 607.39
See application file for complete search history.

(56) References Cited

U.S. PATENT DOCUMENTS

| | | | | |
|---|---|---|---|---|
| 2001/0016457 | A1* | 8/2001 | Taguchi et al. | 439/752 |
| 2009/0042450 | A1* | 2/2009 | Zheng et al. | 439/660 |
| 2009/0130870 | A1* | 5/2009 | Wu et al. | 439/83 |
| 2009/0130873 | A1* | 5/2009 | He | 439/108 |

FOREIGN PATENT DOCUMENTS

| | | |
|---|---|---|
| JP | 2741865 | 4/1998 |

* cited by examiner

*Primary Examiner* — Jean F Duverne
(74) *Attorney, Agent, or Firm* — Wei Te Chung; Ming Chieh Chang

(57) ABSTRACT

An electrical connector includes an insulative housing (1) defining a base portion and a tongue portion extending forwardly from the base portion; a plurality of terminals (2) each having a retention portion, a contacting portion extending forwardly from the retention portion and a tail portion; an insulative spacer disposed behind the base portion, and the insulative spacer (3) defining a plurality of positioning holes for the tail portions passing therethrough, respectively; and waterproof material (5) stuffing corresponding seam between the insulative spacer and the base portion.

14 Claims, 10 Drawing Sheets

ELECTRICAL CONNECTOR WITH WATERPROOF FUNCTION

BACKGROUND OF THE INVENTION

1. Field of the Invention

The present invention generally relates to an electrical connector, and more particularly to an electrical connector having waterproof function.

2. Description of Related Art

Japan patent No. 2741865 issued on Apr. 22, 1998 discloses an electrical connector which includes an insulative housing, a number of terminals supported by the insulative housing and an insulative member assembled to the insulative housing for positioning the terminals. The insulative housing defining terminal grooves and a mating port arranged nearby and communicating with the terminal grooves. The terminals are respectively accommodated in the terminal grooves, and each terminal having a retention portion held by the insulative housing, a contacting portion projecting into the mating portion from one end of the retention portion, and a tail portion connecting with the other end of the retention portion. There are a number of positioning holes defined in the insulative member for tail portion therethrough. However, as there is a seam between the insulative housing and the insulative member, and water or dust may enter an interior of the connector via the seam.

Hence, an improved electrical connector is highly desired to overcome the disadvantages of the related art.

SUMMARY OF THE INVENTION

Accordingly, an object of the present invention is to provide an electrical connector with waterproof or dustproof function.

In order to achieve the object set forth, an electrical connector in accordance with the present invention comprises an insulative housing defining a base portion and a tongue portion extending forwardly from the base portion; a plurality of terminals each having a retention portion, a contacting portion extending forwardly from the retention portion and a tail portion; an insulative spacer disposed behind the base portion, and the insulative spacer defining a plurality of positioning holes for the tail portions passing therethrough, respectively; and waterproof material stuffing corresponding seam between the insulative spacer and the base portion.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
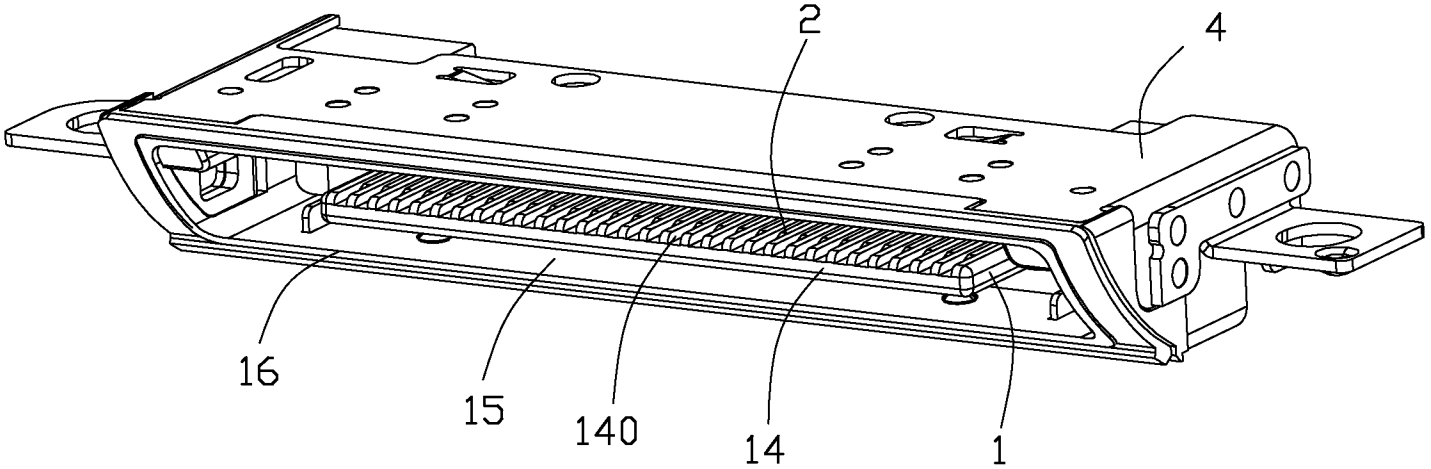
FIG. 1 is an assembled, perspective view of an electrical connector.
Figure 2:
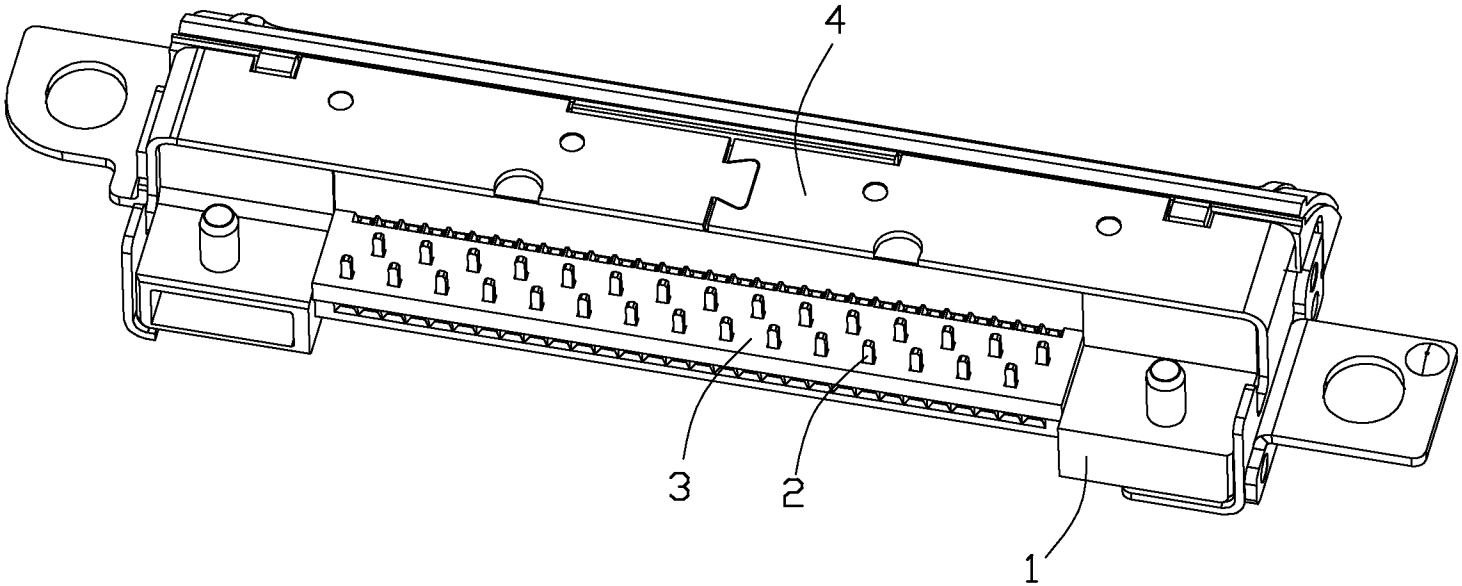
FIG. 2 is similar to FIG. 1, but viewed from other aspect.
Figure 3:
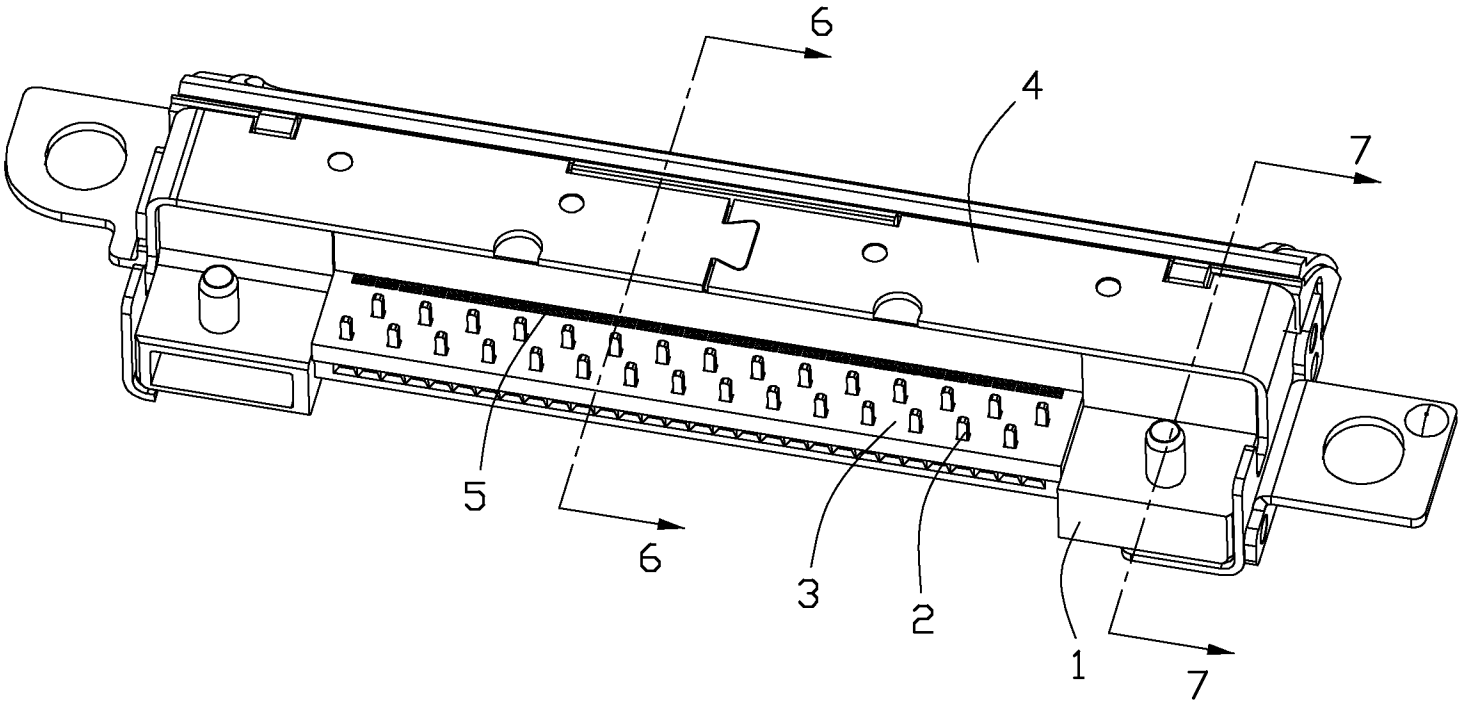
FIG. 3 shows glue applied to a seam between an insulative housing and a spacer.
Figure 4:
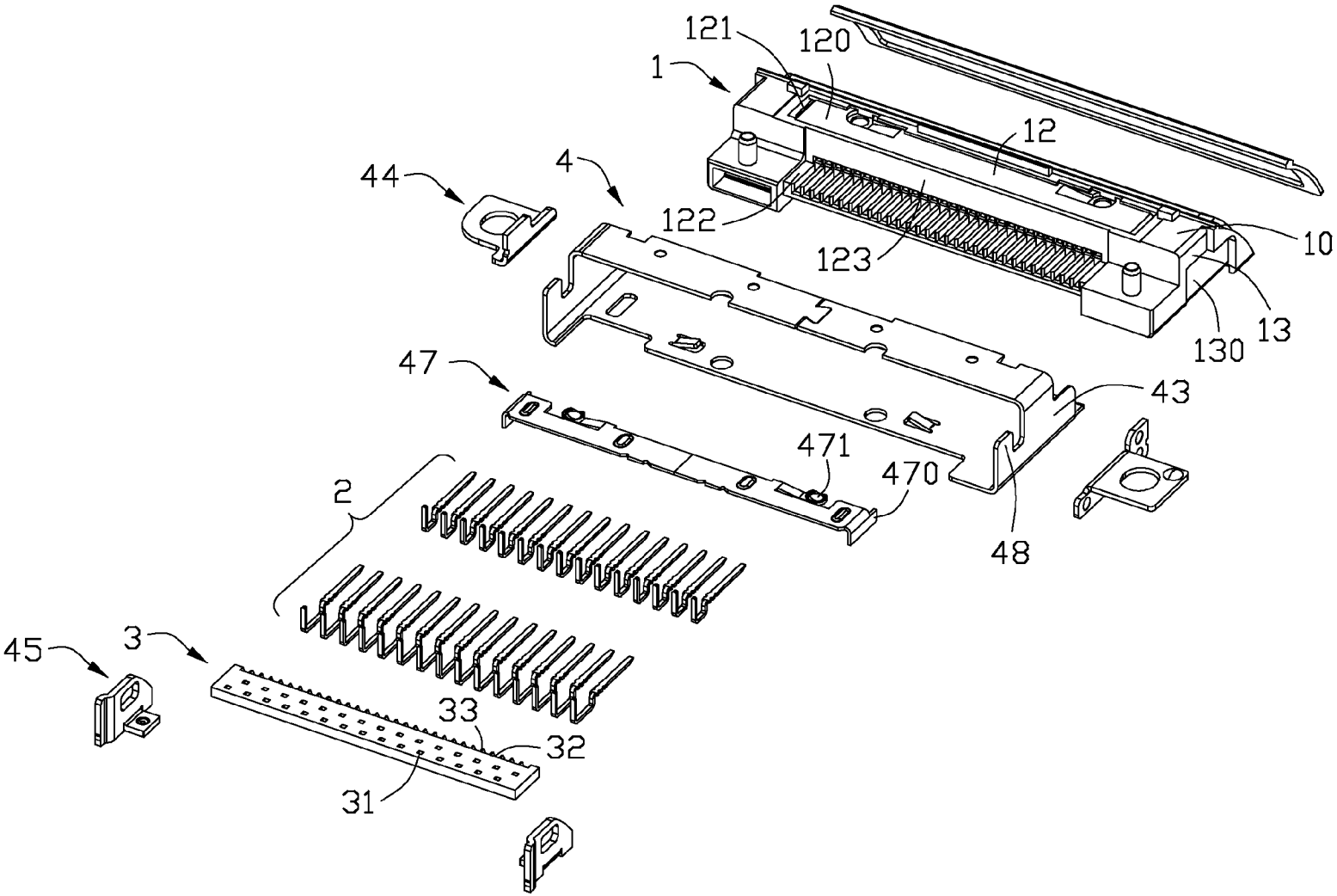
FIG. 4 is an exploded, perspective view of the electrical connector.
Figure 5:
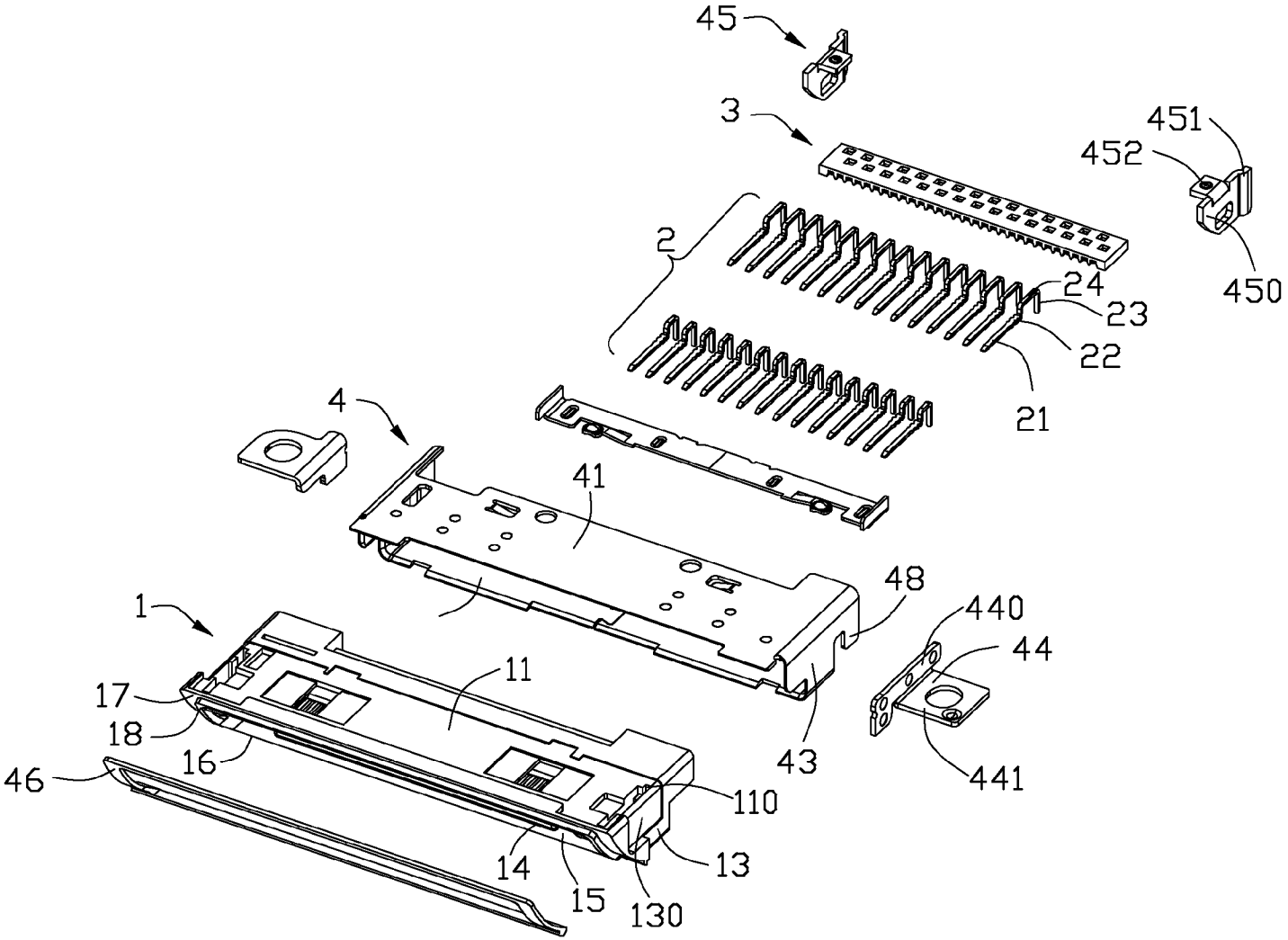
FIG. 5 is a view similar to FIG. 4, but viewed from other direction.
Figure 6:
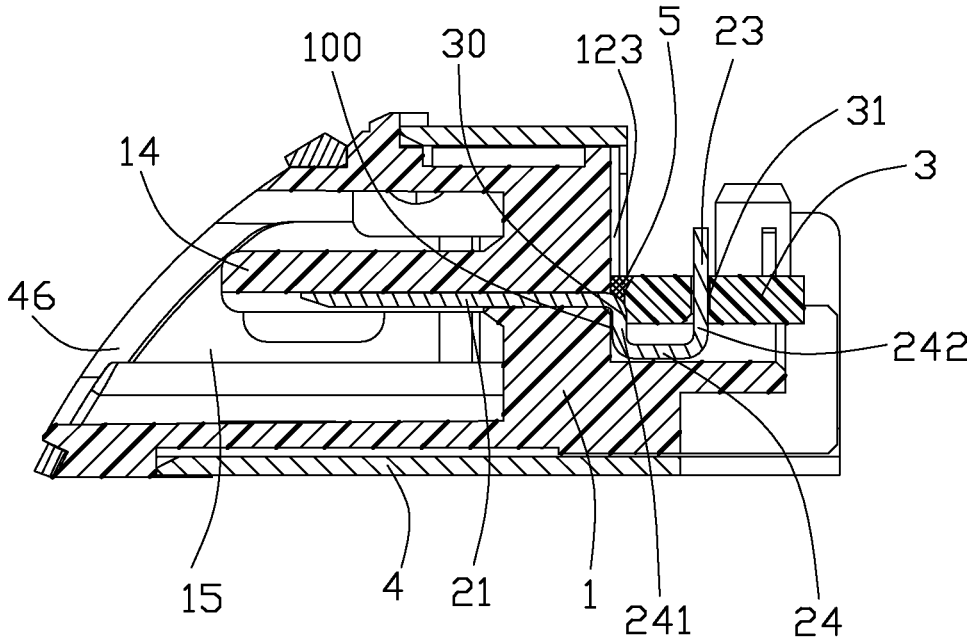
FIG. 6 is a cross section view of FIG. 3 taken along line 6-6.
Figure 7:
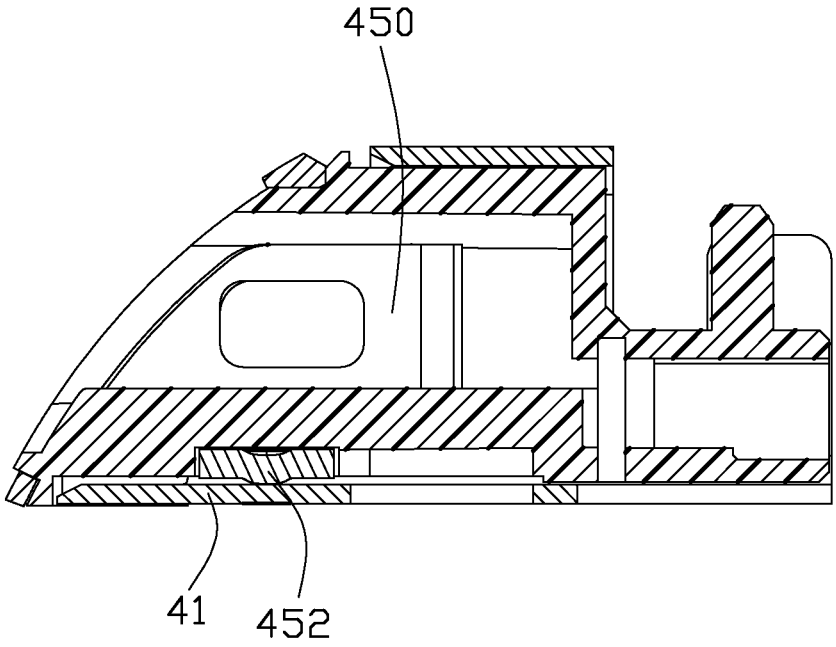
FIG. 7 is a cross section view of FIG. 3 taken along line 7-7.
Figure 8:
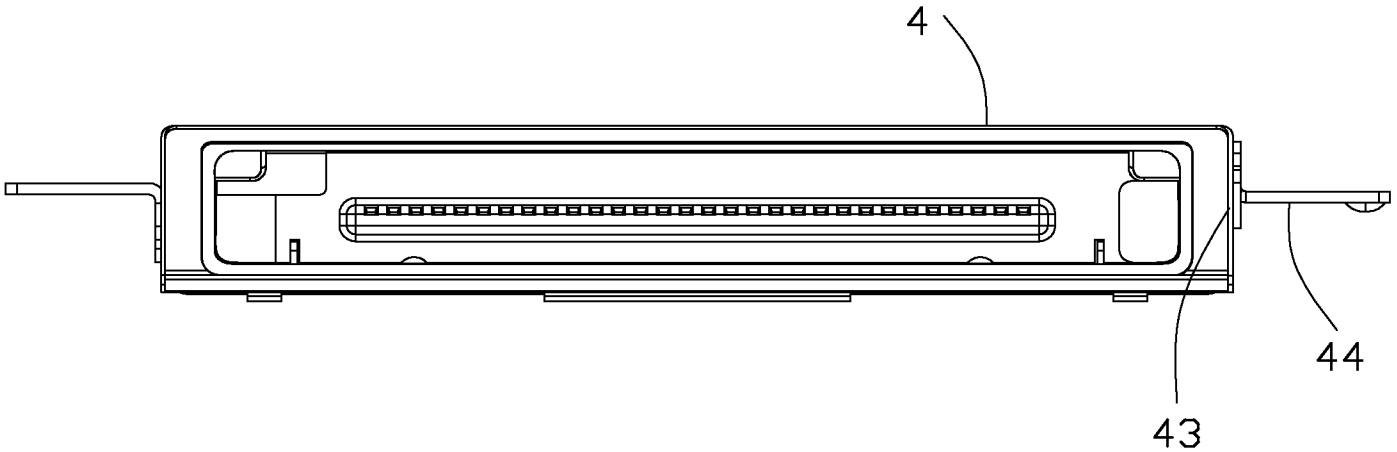
FIG. 8 is a front side view of the electrical connector.
Figure 9:
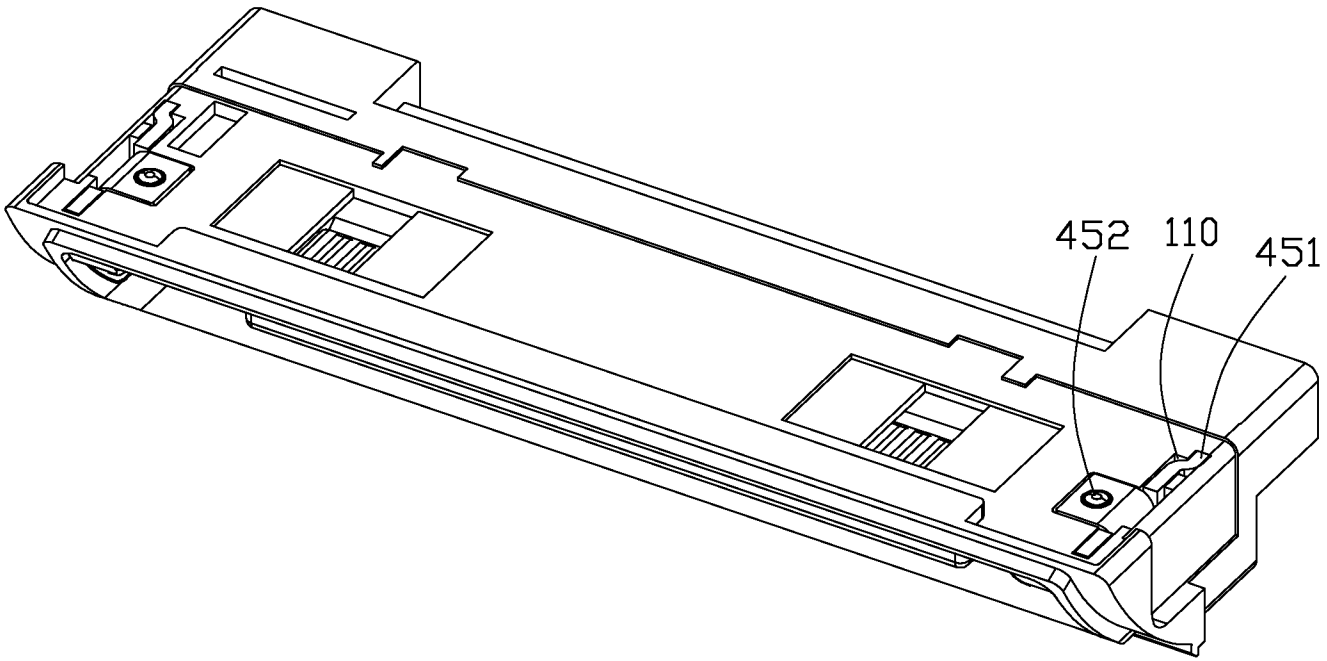
FIG. 9 is partially assembled view of the electrical connector.
Figure 10:
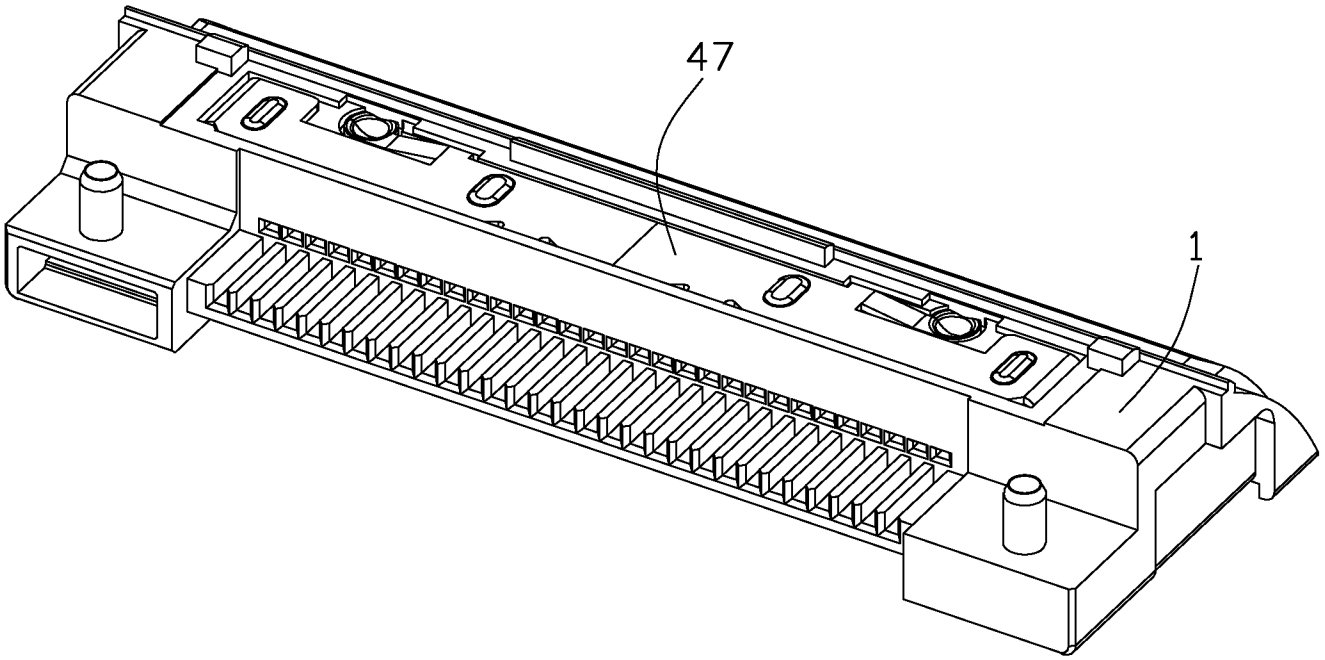
FIG. 10 is another partially assembled view of the electrical connector.

Referring to FIGS. 1-10, an electrical connector in accordance with the present invention comprises an insulative housing 1, a plurality of terminals 2 supported by the insulative housing 1, an insulative spacer 3 for positioning the terminals 2 and a metallic shell 4 enclosing the insulative housing 1.

The insulative housing 1 has an elongated base portion 10, a top wall 11, a bottom wall 12 and two lateral walls 13 extending forwardly from the base portion 10. There is a mating port 15 formed between the top wall 11, the bottom wall 12 and the two lateral walls 13. There is an front opening 16 located in a front end of the mating port 15. In addition, a tongue portion 14 is located in the mating port 15 and extends forwardly from the base portion 10. There are plurality of terminal grooves 140 located in an upper and lower sides of the tongue portion 14. The terminals 2 are positioned in the terminal grooves 140, respectively.

Each terminal 2 has a retention portion 22 received in a corresponding terminal groove 140, a contacting portion 21 extending forwardly from the retention portion 22 and a tail portion 23 projecting downwardly and a inverted U-shaped connecting portion 24 connecting with the retention portion 22 and the tail portion 23. The connecting portion 24 with a front vertical segment 241 abuts against a back wall 100 of the base portion 10 and further pressed by the insulative spacer 3.

The metallic shell 4 is made of metallic sheet and includes a top side 41, a bottom side 42 and two lateral sides 43. There are two board mounting portions 44 respectively attached to the two lateral sides 43. The board mounting portion 44 has an engaging portion 440 located in a vertical plane and soldered to an outer surface of the corresponding lateral side 43, and a supporting portion 441 laterally projecting from a bottom of the engaging portion 440 and adapted for soldering to a corresponding printed circuit board (not shown) on which the electrical connector is mounted. The engaging portion 440 and the corresponding lateral side 43 are mounted to a recess 130 defined in a lateral side of the side wall 13.

There are two retainers 45 arranged adjacent to inner surface of the two lateral sides 43, respectively. In addition, two mounting cavities 110 are located in lateral sections of the insulative housing 1 for accommodating the retainers 45 therein. The retainer 45 has a main section 450, a retaining section 451 extending backwardly and outwardly from the main section 450 and an engaging pad 452 extending inwardly from a top edge of the main section 450. The main section 450 and the retaining section 451 are positioned the corresponding mounting cavity 110, and the engaging pad 452 is soldered to the top side 41.

The insulative housing 1 has a front surface 17 and loop flange 18 formed on the front surface 17. The loop flange 18 is disposed in front of the opening 16. There is a gasket 46 assembled to the flange 18. A transversal depression 120 defined in the bottom wall 12 of the insulative housing 1, and two slots 121 are located in opposite ends of the depression 120 and further communicate with the mating port 15. A metallic bar 47 is mounted to the depression 120, with two guiding portions 470 formed at opposite sides of the metallic bar 47 and further inserted into the mating port 15 via the two slots 121, respectively. The guiding portions 470 are used for guiding a complementary connector (not shown) correctly mating with the electrical connector. There are two spring tabs 471 formed at a back section of the metallic bar 47 and further spaced apart from each other along the transversal direction, and each spring tab 471 has a free end protruding into the mating port 15. When the electrical connector mates with the complementary connector, and the spring members 471 are urged upwardly to contact/touch with the bottom side 42. There are two legs 48 respectively formed on the lateral sides 43 and the legs 48 are further soldered to printed circuit board (not shown). Thus, a signal detective path is formed between the spring member 471, the metallic bar 47, the metallic shell 4 and the board mounting portion 44 or the leg 48.

The insluative spacer 3 defines a plurality of positioning holes 31 for the tail portions 23 passing therethrough. The insulative spacer 3 is mounted to the base portion 10 of the insulative housing 1. There is a platform 122 horizontally projecting from the back wall 100 of the base portion 10. The insulative spacer 3 has a plurality partitions 33 formed at a front section thereof, and each of two partitions 33 are separated by a gap 32. The insulative spacer 3 is assembled to the platform 122 and abuts against a back surface 123 of the back wall 100. There is a seam formed between a front surface of the insulative spacer 3 and the back surface 123, and the seam is stuffed by waterproof material 5, i.e., glue or other adhesive material, which is applied to the gaps 32. Therefore, water or dust can not enter the electrical connector via the seam between the insulative housing 1 and the insulative spacer 3.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing defining a base portion and a tongue portion extending forwardly from the base portion;

a plurality of terminals each having a retention portion, a contacting portion extending forwardly from the retention portion and a tail portion;

an insulative spacer disposed behind the base portion, and the insulative spacer defining a plurality of positioning holes for the tail portions passing therethrough, respectively;

a plurality of partitions are formed at a front section of the insulative spacer for abutting against a back side of the base portion, and the partitions are separated from each other by a corresponding gap; and waterproof material is applied into the gaps to stuff a corresponding seam between the insulative spacer and the base portion.

2. The electrical connector as claimed in claim 1, wherein the waterproof material is adhesive material.

3. The electrical connector as claimed in claim 2, wherein the adhesive material is glue.

4. The electrical connector as claimed in claim 1, wherein there is a platform projects backwardly from the base portion and the insulative spacer is mounted to the platform.

5. An electrical connector, comprising:

an insulative housing defining a base portion, a plurality of walls extending forwardly from the base portion to form a mating port thereamong, and a tongue portion extending forwardly from the base portion and located in the mating port;

a plurality of terminals supported by the tongue portion, each having a retention portion, a contacting portion extending forwardly from the retention portion and accommodated in the mating port, and a tail portion disposed behind the base portion;

an insulative spacer mounted to the base portion, and the insulative spacer defining a plurality of positioning holes for the tail portions passing therethrough, respectively;

the insulative spacer and the base portion sealed therebetween so as to prevent water or dust into an interior of the insulative housing; and a metallic shell enclosing the insulative housing; wherein a depression is defined in the bottom wall of the insulative housing, and a metallic bar is accommodated in the depression; wherein at least one spring tab is formed with the metallic bar and the spring tab has a free end protruding into the mating port and capable of projecting upwardly to contact with the bottom side of the metallic shell.

6. The electrical connector as claimed in claim 5, wherein glue is applied to seal corresponding seam between the base portion of the insulative housing and the insulative spacer.

7. The electrical connector as claimed in claim 5, wherein the terminal further has an inverted U-shaped connecting portion respectively connecting with the retention portion and the tail portion.

8. The electrical connector as claimed in claim 5, wherein there is at least one board mounting portion attached to an outer surface of a lateral side of the metallic shell.

9. The electrical connector as claimed in claim 8, wherein the board mounting portion has an engaging portion located in a vertical plane and soldered to the outer surface of the corresponding lateral side, a supporting portion laterally projecting from a bottom of the engaging portion.

10. The electrical connector as claimed in claim 5, wherein there is at least one retainer which has a main section positioned in the mounting cavity located in the insulative housing and an engaging pad soldered to an inner surface of the metallic shell.

11. The electrical connector as claimed in claim 5, wherein the insulative housing has a front surface with a loop flange formed thereon, and there is a gasket assembled to the flange.

12. An electrical connector assembly comprising:

an insulative housing defining a mating tongue for mating with a complementary connector, and a mounting face essentially for mounting to a printed circuit board;

a plurality of contacts disposed in the housing with horizontal contacting sections exposed upon the mating tongue and vertical tail sections extending around the mounting face; and an insulative spacer attached to a rear side of the housing and defining a plurality of through holes to have said tail sections extend therethrough; wherein an interface between the spacer and the housing in a front-to-back direction defines a slit filled with sealant for waterproof under condition that at least one of said housing and said spacer at said interface defines a plurality of tiny cutouts to receive excessive sealant.

13. The electrical connector assembly as claimed in claim 12, wherein said tiny cutouts are formed in the spacer.

14. The electrical connector assembly as claimed in claim 12, wherein said mating tongue and said mounting face are located at essentially a same level.

* * * * *